US005271103A

United States Patent [19]

Darnell

[11] Patent Number: 5,271,103

[45] Date of Patent: Dec. 21, 1993

[54] IMPACT PROTECTIVE HEADGEAR

[76] Inventor: Eric A. Darnell, Star Rte., South Strafford, Vt. 05070

[21] Appl. No.: 962,949

[22] Filed: Oct. 19, 1992

[51] Int. Cl.[5] ..... A42B 1/22; A63B 71/10

[52] U.S. Cl. ..... 2/418; 2/411; 2/424; 2/425

[58] Field of Search ..... 2/410, 411, 412, 424, 2/425, 414, 417, 418, 420, 197

[56] References Cited

U.S. PATENT DOCUMENTS

| | | | |
|---|---|---|---|
| 1,373,446 | 4/1921 | Pierce | 2/418 |
| 1,522,952 | 1/1925 | Goldsmith | 2/414 |
| 1,559,252 | 10/1925 | Hartman | 2/418 |
| 3,107,356 | 10/1963 | Pestronk et al. | 2/197 |
| 3,315,273 | 4/1967 | Bullard | 2/418 |
| 3,577,562 | 5/1971 | Holt | 2/414 |
| 3,787,894 | 1/1974 | Goodman, Jr. | 2/418 |
| 5,093,936 | 3/1992 | Copeland et al. | 2/410 |

FOREIGN PATENT DOCUMENTS

| | | | |
|---|---|---|---|
| 2202729 | 10/1988 | United Kingdom | 2/411 |

*Primary Examiner*—Clifford D. Crowder
*Assistant Examiner*—Michael A. Neas
*Attorney, Agent, or Firm*—Barry R. Blaker

[57] ABSTRACT

Impact protective headgear is disclosed wherein impact protection to the brain case of the skull is at least in part provided by a molded skull enclosing component composed of a relatively thick and stiff cellular polymer material. Provisions are disclosed by which the relatively stiff molded component is rendered size adjustable.

21 Claims, 7 Drawing Sheets

IMPACT PROTECTIVE HEADGEAR

BACKGROUND OF THE INVENTION

The present invention broadly relates to impact protective headgear and is more particularly concerned with size adjustable impact protective headgear comprising a relatively thick impact energy absorptive skull encasing component composed of a molded cellular polymer material.

In many human sport and industrial activities, such as in bicycle racing and touring, auto racing, jogging, horseback riding, baseball, lacrosse, hockey, demolition and construction work and the like it is important that impact protective headgear be worn. A common type of impact protective headgear for such activities comprises a relatively stiff and thick impact energy absorptive skull encasing component composed of a molded cellular polymer material, such as polystyrene, copolymers of styrene and maleic anhydride or acrylonitrile, polyethylene, polypropylene or ethylene-propylene copolymers. Often, but not always, such headgear also comprises an exterior shell composed of a tough, abrasion and impact resistant non-cellular sheet polymer material such as glass reinforced polyester, polyethylene, polypropylene, polycarbonate or acrylonitrile-butadiene-styrene copolymers. In this latter instance, of course, the skull encasing molded cellular component functions as an energy absorptive liner for the shell and the overall headgear construction may be in the nature of a helmet or cap.

The relatively stiff skull encasing energy absorbing molded cellular polymer headgear components, usually having an average thickness of at least about ¼ inch (0.635 cm) and often having an average thickness of about ½ inch (1.27 cm) or greater, have been found to be possessed of several important beneficial qualities which befit them for the task. Firstly, molded cellular polymer wares are generally of relatively low density, thereby allowing production of molded cellular impact absorptive skull encasing headgear components which are comfortable to wear due to their light weight. Another important benefit attributable to molded cellular polymer headgear components resides in the generally excellent energy absorptive properties thereof. Moreover, the energy absorptive qualities of such molded skull encasing headgear components can often be tailored to ideally befit the specific impact protective task to be served, such as by suitable selection of the starting expandable polymer materials and/or molding conditions.

While substantially any conventional cellular polymer molding process may be utilized in the manufacture of such skull encasing headgear components, the specific process of current commercial preference is the so-called "expandable bead" molding process. In expandable bead molding thermoplastic polymer beads, containing one or more physical blowing agents such as a fluorocarbon, propane, butane or pentane, are charged into a slightly opened steam heated mold, the mold closed and steam (or hot air) injected into the closed mold in order to expand the beads into conformance with the mold cavity and to cause them to coalesce and weld together within the mold. The thusly molded cellular product is then cooled within the mold, usually by circulating cooling water around the mold, the mold opened and the molded ware removed therefrom. Then, the molded ware is generally heat cured, in an oven, for a period of time sufficient to relieve internal molding stresses and to thereby allow the ware to assume its finished shape. By judicious control of the mold conditions and the feed material expandable polymer beads it is possible to provide the finished molded ware with a protective continuous external polymer skin as well as to control density, cell size, cell size distribution and cell wall thickness. In a variant of this general process, the expandable beads, prior to molding thereof, are first subjected to one or more stages of preexpansion by heating thereof in steam or hot air in an unconfined volume so as to avoid premature adherence of the beads to one another. Further details concerning the general methodology of expandable bead molding of polystyrene and its copolymers may be had by reference to such published works as *Encyclopedia of Polymer Science and Technology*, H. Mark et al, Eds., John Wiley & Sons, Inc., 1989, Vol. 16, pgs. 201–204 and *Ullmann's Encyclopedia of Industrial Chemistry*, 5th Ed., W. Gerhartz et al., Eds., VCH Verlagsgesellschaft mbH, 1988, Volume All, pgs. 445–447.

One of the problems associated with the relatively thick and stiff cellular polymer skull encasing headgear components of the prior art resides in the requirement for utilizing a separate and distinct mold for each of the many sizes of the component required to provide proper fitting of the finished headgear to the range of head sizes found in the human population. This, of course, adds substantially to the overall cost of manufacture. Moreover, maintaining and controlling inventories of the variously sized molded cellular polymer headgear components imposes yet another substantial burden, not only upon the protective headgear manufacturer but also upon the distributor and retailer of such goods. Accordingly, it is a highly desirable goal to provide an impact protective headgear construction comprising a molded impact absorptive cellular polymer skull encasing component whose size is adjustable over a range of head sizes. In accordance with the present invention, this goal has been achieved.

OBJECTS OF THE INVENTION

It is a principal object of the invention to provide a novel impact protective headgear construction.

It is another object of the invention to provide an impact protective headgear construction comprising a relatively thick and stiff, but size adjustable, skull encasing, impact absorptive cellular polymer component.

It is yet another object of the invention to provide an impact protective headgear construction comprising an exterior shell component composed of a tough, impact resistant polymer sheet material and, housed therewithin, a relatively thick and stiff, but size adjustable, skull encasing, impact absorptive, cellular polymer liner component.

It is still another object of the invention to provide a novel impact protective headgear construction in the nature of a size adjustable helmet.

Other objects and advantages of the present invention will in part be obvious and will in part appear hereinafter.

SUMMARY OF THE INVENTION

In accordance with the invention the impact protective headgear comprises an impact energy absorptive skull encasing component composed of a relatively thick and stiff molded cellular polymer material, said component having a crown portion to overlie the top of the skull and depending front, side and back portions to encase corresponding portions of the skull. Extending from the crown portion of the skull encasing component and coursing downwardly through the lower margin thereof are at least two spaced apart, preferably opposed, slots. Constricting means, which may be adjustable or non-adjustable, are provided to inwardly bias the front, sides and back portions of said component and to urge said slots towards a closed condition, thereby to size said component to the head of a wearer thereof. In a preferred embodiment of the invention the molded cellular polymer component is in the nature of a liner and is enclosed within an exterior tough abrasion and impact resistant shell component comprising the constricting means for said liner.

DESCRIPTION OF PREFERRED EMBODIMENTS

Figure 1:
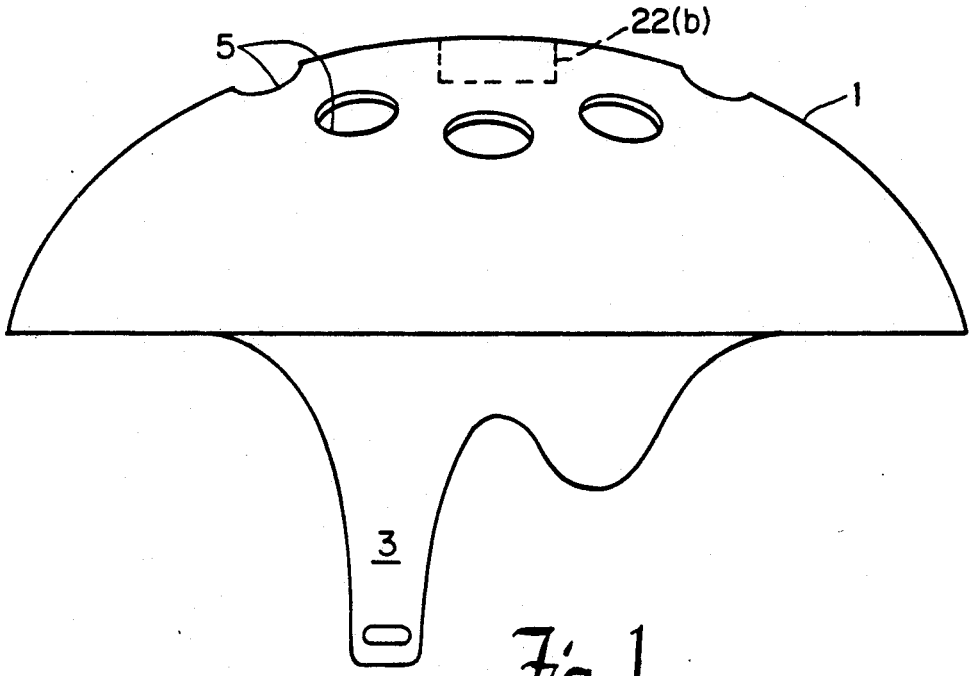
FIG. 1 is a side elevational view of the exterior shell component of an impact protective helmet in the nature of a bicyclist's helmet.
Figure 2:
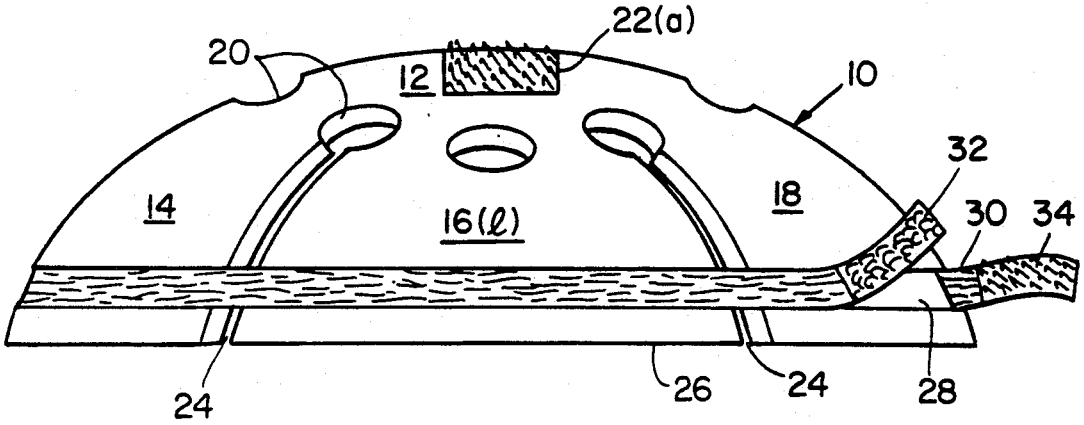
FIG. 2 is a side elevational view of a relatively thick and stiff impact absorptive skull enclosing cellular polymer headgear component construction in accordance with the invention, said component being adapted to be received into the exterior shell of FIG. 1 as a liner therefor.
Figure 3:
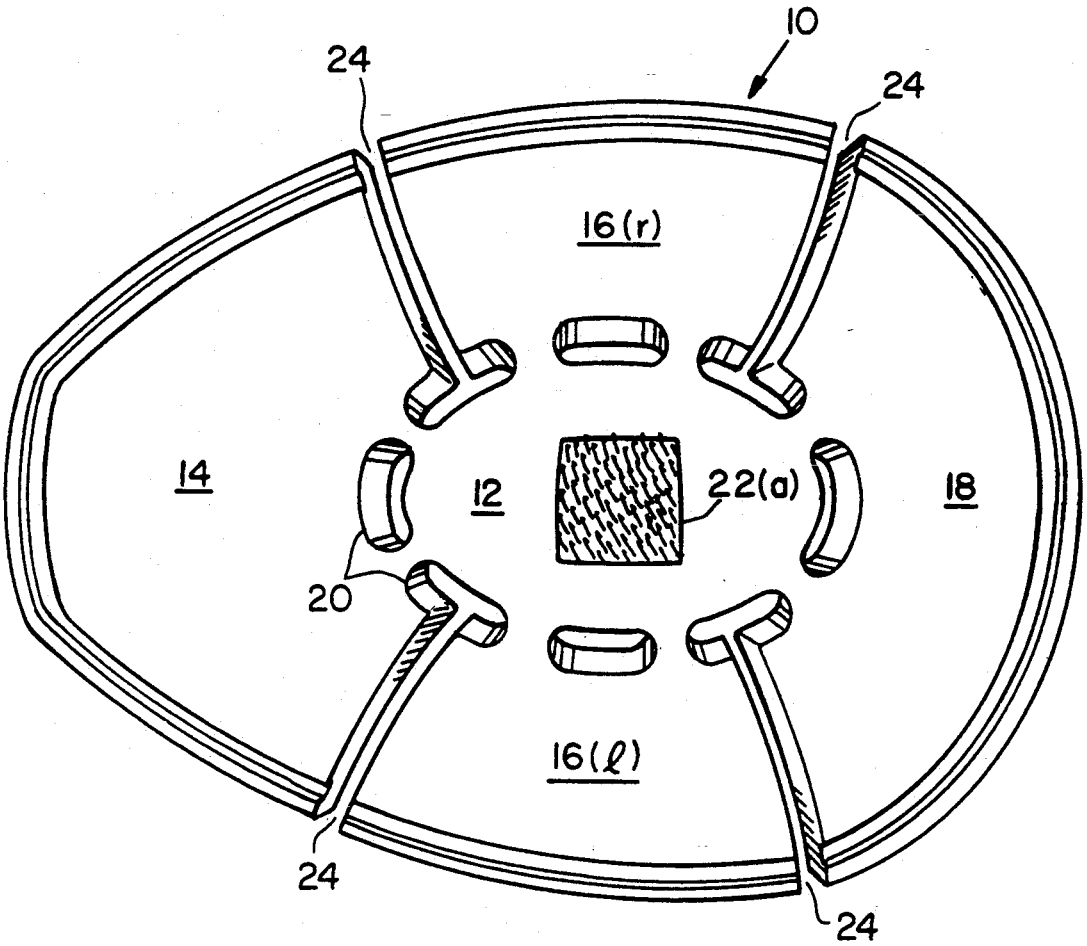
FIG. 3 is a top plan view of the liner component of FIG. 2.
Figure 4:
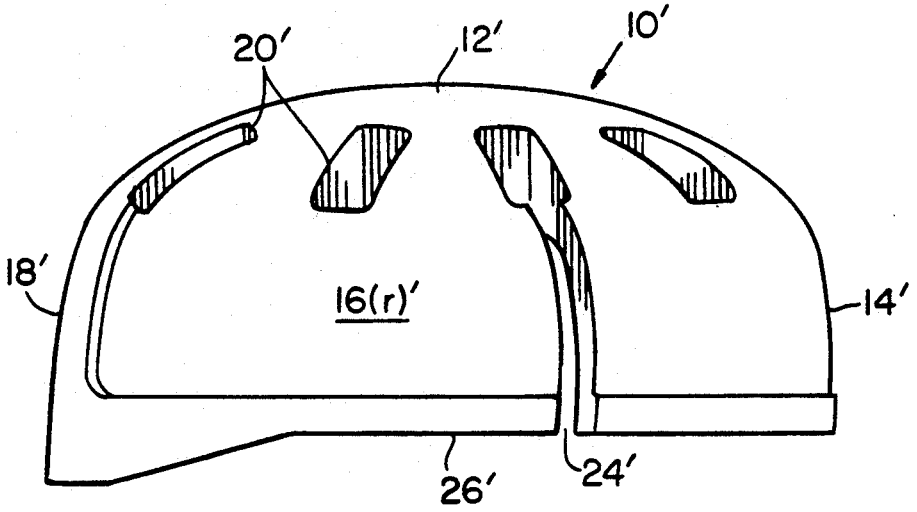
FIG. 4 is a side elevational view of another impact absorptive molded cellular polymer headgear component construction in accordance with the invention, said component being adapted to be utilized as a liner component for an athletic helmet.
Figure 5:
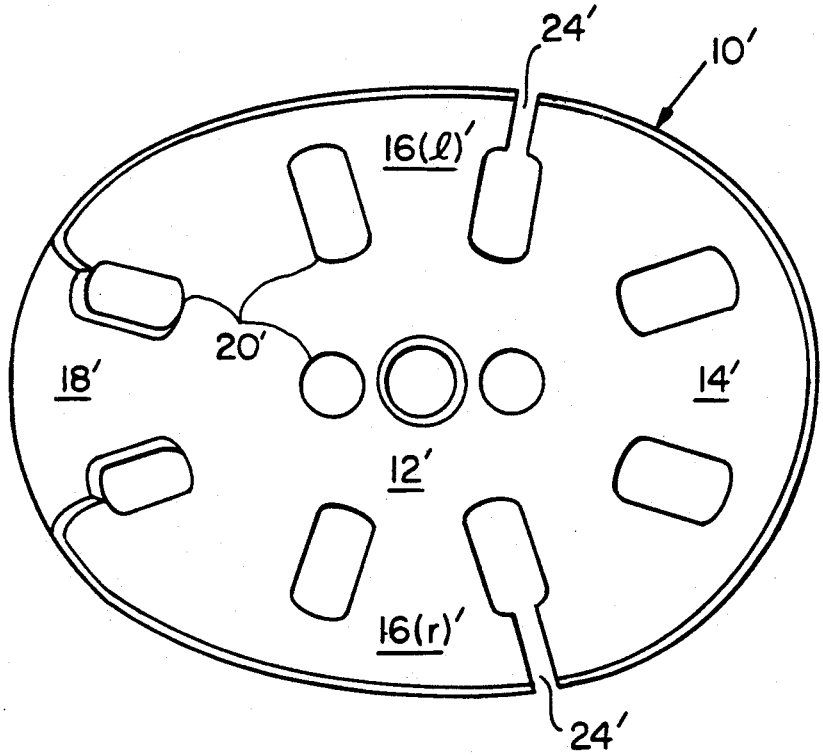
FIG. 5 is a top plan view of the liner component of FIG. 4.
Figure 10:
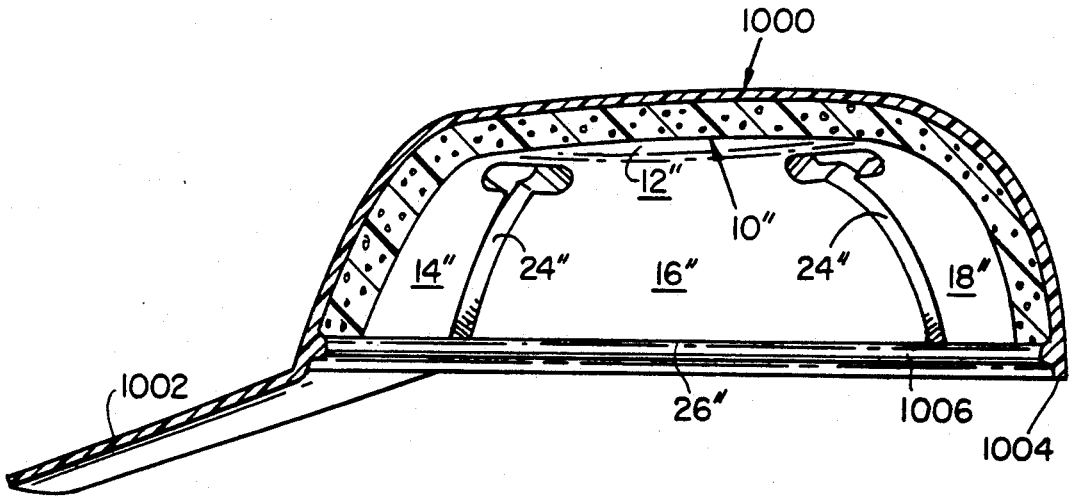
FIG. 10 is a sectional side view of another embodiment of the headgear construction of the invention comprising a tough and abrasion resistant exterior shell component and an energy absorptive snap-in cellular polymer liner component and wherein said shell element, by its own fixed sizing, constitutes a non-adjustable passive constricting means for sizing of said liner component.

Referring now to FIGS. 1 through 3, wherein like reference numerals refer to like structures, there is shown in FIG. 1 an exterior shell headgear component 1 composed of a tough non-cellular polymer sheet material and, in FIGS. 2 and 3, a relatively thick and stiff impact energy absorptive liner component 10 composed of a molded cellular polymer material, the exterior of said liner component 10 being of a shape to be received and secured into the shell component 1. The shell component 1 also comprises means 3 to secure the headgear construction to the head of the wearer, such as in the nature of a chin strap 3. As mentioned, liner component 10 is composed of a molded cellular polymeric material and comprises a crown portion 12 to overlie the top of the skull and, depending therefrom, front, side and back portions 14, 16(*l*), 16(*r*) and 18, respectively, to overlie corresponding portions of the skull of the wearer. With respect to the material of construction of said component 10 it is preferred that the polymer employed be a relatively crystalline alpha-olefin, such as polyethylene, polypropylene or a copolymer of ethylene and propylene. The principal reason for my preference in this regard is that cellular wares produced with such relatively crystalline alpha-olefinic polymers are usually possessed of a more resilient character than those produced from glassy or amorphous polymers, such as polystyrene. Thus, molded impact energy absorptive cellular headgear components 10 of the present invention produced with such preferred crystalline polymers tend to be relatively resilient, with improved resistance to permanent and destructive crushing deformation thereof due to impact events. In another preferred embodiment of the invention the crown portion 12 of the molded cellular polymer liner component 10 is circumscribed with a plurality of ventilation apertures 20 and the exterior shell component 1 is provided with corresponding ventilation apertures 5, thereby to provide for ambient air circulation about the wearer's head. In addition, suitable means are provided by which to secure the liner component 10 into the shell component 1. In the embodiment of the invention shown in FIGS. 1 through 3 hereof, said means takes the form of cooperative hook and loop fastener elements, such as are available under the brandname, VELCRO fasteners, from Velcro USA, Inc., Manchester, N.H. One hook or loop fastener element 22(*a*) is secured to the center of the crown portion 12 of the liner component 10 while the cooperative hook or loop fastener element 22(*b*), shown in phantom in FIG. 1, is secured to the corresponding location on the interior surface of the shell component 1. As will be readily appreciated, upon assembly of the liner component 10 into the shell component 1, the cooperative hook and loop fastener elements 22(*a*) and 22(*b*) are placed in interlocking, but separable, relationship with one another, thereby securing the liner component 10 to the interior of the shell component 1. It should be mentioned, however, that the particular means by which the liner component 10 is secured to the shell component 1 is not critical and that many alternative and/or equivalent securing means will be obvious to those of skill in the art, including cooperative snap-together features on the shell and liner (an embodiment of which is shown in FIG. 10 and will be explained in detail hereinafter), polymeric or metallic through fasteners or cementing of the liner 10 to the shell 1.

An essential element in the construction of the invention is the provision of at least two spaced apart, preferably opposed, slots 24 depending from the periphery of the crown portion 12 of the liner component 10 and extending through the lower margin 26 thereof. It is the principal role of said slots 24 to provide the depending portions of the otherwise relatively stiff and thick molded cellular polymer component 10 with sufficient resilience and clearances as to be readily inwardly biased or constricted, so as to enable selective reduction in the head size thereof from its larger, as-produced, head size. Accordingly, the number and widths of the slots 24 are subject to considerable variation and will be dictated by such considerations as: (a) the inherent stiffness of the cellular polymer material of construction, (b) the thickness of the depending portions of the impact absorptive cellular polymer liner component 10, (c) the head size reduction range desired of the component 10 and the like. As will be apparent, for any given situation, the greater the number of said spaced apart depending slots 24 and/or the greater the widths thereof, the greater will be the reduction in stiffness of the depending portions of the impact absorptive cellular polymer component 10 and the greater will be the available extent of head size reduction thereof. Obviously, however, the widths of the slots 24 should not be so great as to adversely affect the impact absorptive properties of the component 10 or to unacceptably increase the likelihood of exposure of the skull of the wearer to a direct impact through any of the slots 24, such as may exist with respect to protective headgear designed for use in such contact stick sports as lacrosse or hockey. Suffice it to say, therefore, that a rational selection of the number and/or widths of the slots 24 can be readily determined for any given headgear design situation bearing the above considerations in mind and, further, that a suitable final slot 24 width and number can be elicited by simple experimentation utilizing a number of prototypal component 10 samples prepared with slots 24 of differing widths and/or numbers. For instance, a number of molded samples of the component 10 can be prepared without the slots therein and slots 24 of differing sizes and/or number and/or spacing readily machined thereinto for testing purposes. When the final design of the component 10 has been achieved, the slots 24 can be conveniently formed during the molding thereof, particularly when the molding process employed is the expandable bead process described previously. Generally speaking, at least for protective headgear designed for contact stick sports such as hockey or lacrosse, I also prefer that the positioning of the slots 24 of the cellular polymer liner component 10 be selected such that, upon assembly of the liner component 10 into the exterior shell component 1, said slots 24 will underlie the strongest portions of said liner component 10.

The constricting means by which the depending portions of the component 10 are inwardly biased to reduce the head size thereof can take many forms and can be in direct or indirect contact with the component 10 and can be non-adjustable or, preferably, adjustable. In the embodiment of the invention shown in FIGS. 1 through 3, and as may be best seen from FIG. 2, an adjustable constricting means is in direct contact with the component 10 and is defined by a fully circumscribing belt or strap 30 which resides in a circumferential groove 28 molded into the exterior of the component 10 near the lower margin 26 of the depending portions 14, 16(*l*), 16(*r*) and 18 thereof. Said belt or strap 30 comprises securing means located at the respective end portions thereof, which securing means may conveniently take the form of cooperative hook and loop fastener elements 32 and 34. In order to size the liner component 10 of FIGS. 1 through 3 hereof it is placed on the head of the wearer and the end portions of the belt or strap 30 drawn together, thereby directly biasing and constricting the depending portions of the liner component inwardly and reducing the head size of the component 10 until a comfortable fit is achieved. Then, the hook and loop fastener elements of the end portions of the belt or strap 30 are secured to one another, thereby securing the adjusted size of the liner component 10. It will be understood, of course, that the constricting means can take many forms other than the strap 30 and hook and loop fastener element 32, 34 combination shown in FIG. 2. For instance, full equivalents thereof can be had by use of such diverse substitute strapping arrangements of commerce as straps having buckle means, polymeric wire bundle ties composed of, for instance, nylon and screw clamps.

In FIGS. 4 through 9 hereof there are depicted elements of an impact protective helmet specifically adapted for use in contact stick sports such as lacrosse or hockey and wherein an adjustable constricting means for the multiply slotted molded cellular polymer liner component forms part of the exterior shell component and acts indirectly upon the cellular polymer liner component. Referring now specifically to FIGS. 4 through 7, there is shown a relatively thick and stiff skull encasing helmet liner 10' composed of a molded cellular polymer material and comprising a crown portion 12'. Depending from and integral with said crown portion 12' is a front portion 14', side portions 16(*l*)' and 16(*r*)' and a back portion 18', said depending portions together defining a common lower margin 26' of the liner 10'. The back portion 18' desirably depends to a somewhat lower plane then the front and side portions, thereby to more completely encase the occipital portion of the wearer's skull. The crown portion 12' preferably comprises a plurality of ventilation apertures 20' located both in the central region thereof and spaced about its periphery. Moreover, the peripheral apertures 20' are preferably elongate in shape and are oriented in a generally radial direction relative to the center of the crown portion 12'.

Depending from the periphery of the crown portion 12', preferably from an opposed pair of peripheral ventilation apertures 20' contiguous with the side portions 16(*r*)' and 16(*l*)', are at least one pair of slots 24', each of which slots 24' courses downwardly through its respective side portion and passes completely through the lower margin 26' of the liner 10'. As will be noted, utilizing this preferred construction, each radially oriented elongate peripheral ventilation aperture 20' from which a slot 24' extends becomes, practically speaking, an integral part of the size adjustment structure of the invention and defines the inner end of said slot.

Figure 6:
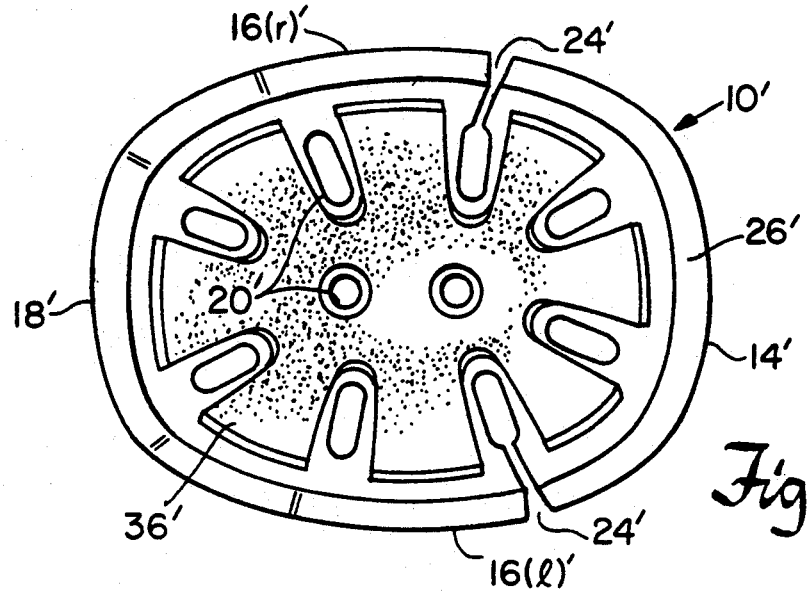
FIG. 6 is a bottom plan view of the liner component of FIG. 4, showing a comfort enhancing padding element affixed to the interior surface thereof.

In the bottom plan view of FIG. 6 there is shown another preferred embodiment of the invention wherein there is attached to the inner surface of the liner 10' a relatively thin sheet form padding element 36'. Desirably, said padding element 36' is in the nature of a soft, readily compressible resilient polymeric foam sheet material, preferably of closed cell construction and preferably composed of a crosslinked polyolefin so as to mitigate against imbibition of and degradation by the wearer's perspiration and scalp oils. Moreover, said padding element 36' is also suitably shaped or die cut such as to maintain direct open communication between the ventilation apertures 20' of the liner 10' and the head of the wearer. Finally, while not specifically shown in FIG. 6, it is also preferred that the padding element 36' be releasably affixable to the inner surface of the liner 10', such as by means of a hook and loop fastener system of a type similar to that described previously with respect to elements 22(a) and 22(b) of the embodiment of the invention shown in FIGS. 1 through 3. By releasably affixing the padding element 36' to the liner 10', of course, said padding element 36' is rendered readily removable for cleansing or replacement purposes.

Figure 7:
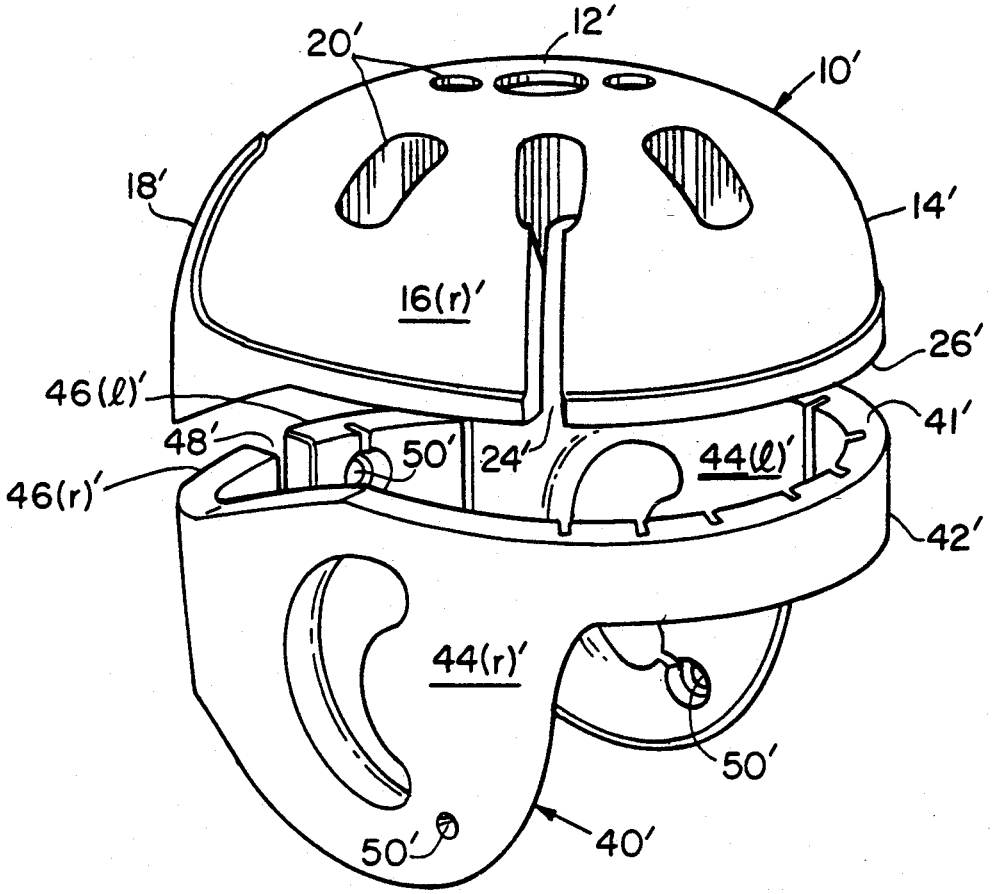
FIG. 7 is a perspective exploded view showing the liner component of FIG. 4 in association with a second energy absorptive liner component composed of a soft resilient polymeric foam disposed thereunder, said second liner component being adapted to afford impact protection to anatomical structures of the head lying below the brain case of the skull.

In protective headgear for contact stick sports it is desirable to provide protection for facial areas of the skull as well as for the brain case, such as along the brow line, sides of the face and ears. In FIG. 7 there is shown, located beneath the liner 10', an essentially completely head encircling padding element 40' which is of an average thickness similar to that of the liner 10' and which, unlike the relatively rigid liner 10' is composed of a soft, readily compressible resilient polymeric foam, such as a closed cell crosslinked polyethylene foam. The upper margin 41' of said padding element 40' is in correspondence with the lower margin 26' of the liner 10', thereby to form a continuous abutting relationship therewith. Padding element 40' comprises a relatively narrow front headband section 42', relatively deeper depending side sections 44(l)' and 44(r)' to overlie the ears of the wearer and, extending rearwardly from each of said side sections, relatively narrow back sections 46(l)' and 46(r)', respectively. The free ends of said back sections 46(l)' and 46(r)' are not in abutting relationship but, instead, are spaced apart as shown at 48'. Said space 48' is desirable for purposes of facilitating adjustment of the head size of the helmet construction. Additionally, the depending side sections 44(l)' and 44(r)' and the back sections 46(l)' and 46(r)' of the padding element 40' each comprises at least one mounting aperture 50' therethrough, which mounting apertures 50' receive fasteners 105 (shown in FIG. 8) so as to secure the padding element 40' and the liner 10' positioned thereabove within the helmet shell 100, as will be discussed in more detail hereinafter.

Figure 8:
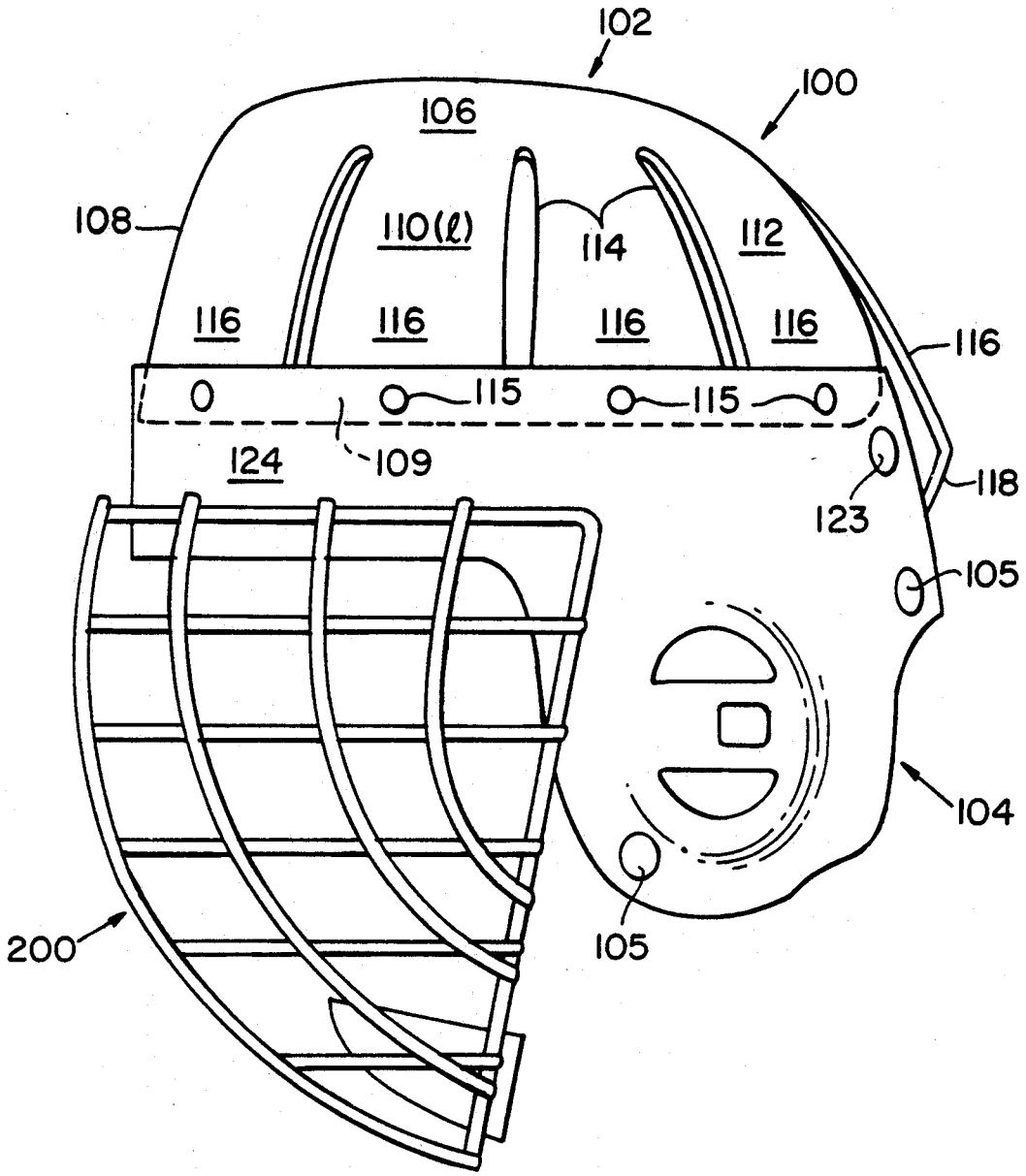
FIG. 8 is a side elevational view of the exterior shell component of an impact protective athletic helmet, said shell component being adapted to receive therein the liner components of FIGS. 4 through 7.
Figure 9:
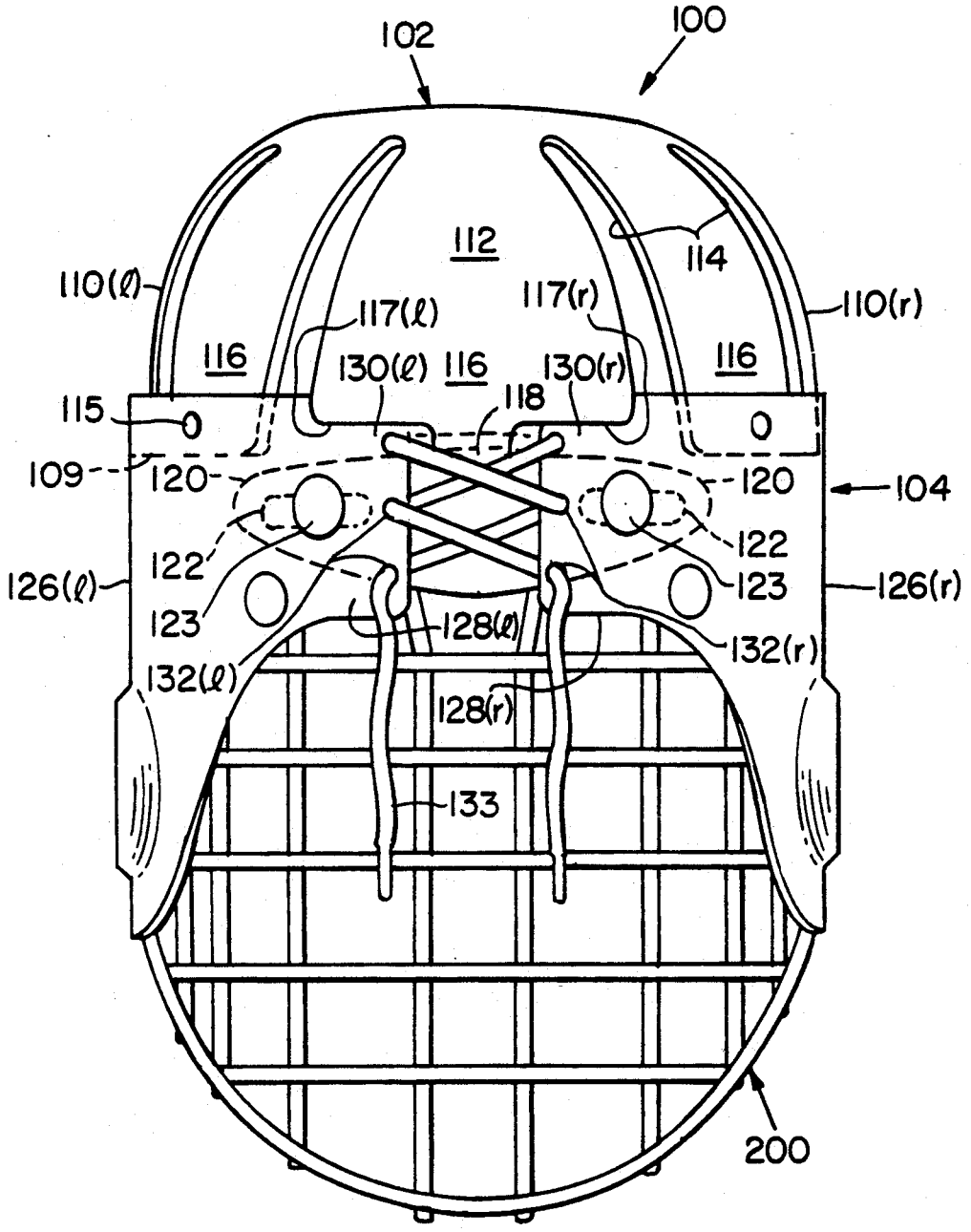
FIG. 9 is a rear, partially phantom, view of the exterior shell component of FIG. 8 showing an adjustable constricting means structure for adjustably sizing the cellular polymeric energy absorptive liner components received therewithin.

FIGS. 8 and 9 hereof depict a helmet shell construction 100 within which the liner and padding elements of FIGS. 4 through 7 are received. Said shell 100 comprises an upper crown element 102 and a head encircling lower element 104, each of which elements is composed of a tough, resilient, abrasion resistant, polymeric sheet material which is preferably thermoplastic. Utilizing such thermoplastic materials the shell elements 102 and 104 can be conveniently formed by such well known forming techniques as die cutting, vacuum, drape or compression molding of thermoplastic sheet materials or by injection molding of bulk particulate thermoplastics. The upper crown element 102 comprises a crown portion 106 and, depending therefrom, a front portion 108, side portions 110(l) and 110(r) and a back portion 112, each said portion corresponding to like portions of the liner component 10' of FIGS. 4 through 7. The depending portions of the crown shell element 102 are additionally provided with a plurality of slots 114 depending from the periphery of crown portion 106 and extending through the lower edge thereof, said slots 114 being generally radially oriented and being located so as to correspond to and overlie the peripheral ventilation apertures 20' of the liner component 10'. Thus, by this construction, the depending portions of the crown shell element 102 are generally defined by a number of separate and distinct spaced apart leaves 116. In the molded version, with the exception of that leaf 116 of back portion 112 which overlies the centerline of the crown shell element 102, the lower edges of the remaining leaves 116 terminate in a continuous rim 109 defining a common lower plane, as shown in phantom. As may best be seen in FIG. 9, that leaf 116 overlying the centerline of the back portion 112 of the crown shell element 102 extends downwardly substantially beyond the lower plane defined by the lower edge of the rim 109. At about said plane, said leaf 116 comprises a short downwardly extending neck section 118 which then abruptly flares to either side of the centerline to define lateral wings 120 (shown in phantom). Each said wing 120 is provided with a laterally extending slot 122 therethrough, said wings and slots together forming an element of the size adjustment means of the construction.

The head encircling lower element 104 of the helmet shell construction 100 comprises a frontal headband section 124, depending side sections 126(l) and 126(r) and, extending rearwardly from each said side section, back tab sections 128(l) and 128(r), respectively. As in the case of the padding 40', the ends 130(l) and 130(r) of tab sections 128(l) and 128(r) do not meet but rather are in spaced apart relationship and comprise an array of lacing holes 132(l) and 132(r) running down the opposed edges thereof. A lace 133 is reeved through the opposed array of lacing holes 132(l) and 132(r) in the usual manner, thereby to allow the opposed spaced apart edges of back tab sections 128(l) and 128(r) to be drawn towards one another. The depending side sections 126(l) and 126(r) and back tab sections 128(l) and 128(r) of the helmet shell element 104 also comprises attachment means, such as in the nature of broad headed fasteners 105, which are in correspondence with the mounting apertures 50' of the padding element 40', said fasteners 105 serving to secure the padding element 40' to the interior of the lower element 104. While substantially any means for attaching the padding element 40' to the lower element 104 is suitable, such as by means of adhesives, stitching or mechanical fasteners, I have found that a particularly preferred fastener 105 is in the nature of a nylon rivet assembly comprising a pair of broad headed interlocking male and female shaft elements. Once assembled, the interlocked shaft elements can not thereafter be separated without destruction of the rivet, thereby ensuring an essentially tamperproof and secure attachment of the padding element 40' to the lower shell element 104. Such fasteners are available, for instance, as medical rivets from the Nexus Division of ITW, Inc., Chicago, Ill.

The crown shell element 102 is assembled to the head encircling lower element 104 in the manner shown, with all of the leaves 116, except the rearmost one, established interiorly of the encircling element 104. The rim 109 of said interiorly oriented leaves 116 is firmly affixed to the encircling element 104, such as by means of a rivet 115. The rearmost leaf 116, in other words, the leaf carrying the lateral wings 120, is brought downwardly over the tab sections (128(l) and 128(r) such that the lower shoulders 117(l) and 117(r) thereof ride exteriorly and the lateral wings 120 thereof ride interiorly of said tab sections. The lateral wings 120 of the rearmost leaf 116 of the crown shell element 102 are then slidingly affixed through the laterally oriented elongate apertures 122 thereof to the interior surfaces of tab sections 128(l) and 128(r), such as by means of broad head rivets 123. As will be appreciated, the resulting helmet shell construction 100 is rendered size adjustable by tightening of the lace 133, thereby drawing the spaced apart opposed ends of the tab sections 128(*l*) and 128(*r*) towards one another and reducing the overall circumference of the helmet shell construction at the plane of the headband. Completing the helmet shell construction is a face mask or cage 200 which may be attached to the helmet shell in any suitable manner.

As is obvious, the helmet construction of the embodiment of the invention depicted in FIGS. 4 through 9 is completed by assembly of first the liner 10' and then the padding element 40' into the helmet shell 100, followed by securing of said padding element 40' to the shell element 104 by means of the aforementioned fasteners 105. It will be appreciated, of course, that once affixed to the shell element 104 the padding element 40' by virtue of its soft resilient composition, relative thickness and an upper margin 41' which corresponds to the lower margin 26' of the liner 10', also functions to support and secure the liner 10' thereabove.

In use, the helmet is placed on the head of the wearer and the lace 133 is drawn sufficiently tightly as to reduce the size of the head encircling element 104, which bears on the liner 10' thereunder and thereby also reduces its size to the point of a suitable fit of the overall helmet construction to the wearer. Thus, the adjustable constricting means employed in the embodiment of the invention shown in FIGS. 4 through 9 functions indirectly upon the liner 10'. Once fitted, of course, the lace 133 is tied off or knotted at the size-adjusted, fitted position.

In FIG. 10 there is shown another embodiment of the invention wherein size adjustment of a relatively thick and rigid energy absorptive cellular polymer liner 10'' component is achieved by constricting said liner component within a tough abrasion resistant shell 1000 component of preselected fixed size and wherein, in addition, said liner 10'' is secured into said shell 1000 by means of a snap-fit arrangement. The shell component 1000, shown in the nature of a cap having a brim 1002, comprises a lower margin 1004. An indwelling bead or ridge 1006, positioned close to the lower margin 1004 of the shell component 1000, runs circumferentially about the interior thereof. While shown as a continuous structure in FIG. 10, said bead or ridge 1006 can also be discontinuous or interrupted in nature, comprising a plurality of spaced apart segments about the interior of the shell component 1000.

As in the embodiments of the invention previously described, the liner component 10'' of FIG. 10 comprises a crown portion 12'' and, depending from said crown portion 12'', front, side and back portions 14'', 16'' and 18'', respectively, said portions terminating at a common plane defining a lower margin 26'' of the liner component 10''. It will be appreciated, of course, that due to the sectional nature of FIG. 10, only the right side portion 16'' of the liner component 10'' is shown, and that it is obvious that a left side portion is also present in the complete construction. Coursing downwardly from the margin of the crown portion 12'' through the depending portions and terminating at the lower margin 26'' of the liner component 10'' are the essential plural spaced apart slots 24'' which, in the particular embodiment shown in FIG. 10, are four in number.

Assembly of the liner component 10'' into the shell component 1000 is performed simply by forcing said liner component into said shell component, during which operation the depending portions 14'', 16'' and 18'' of said liner component 10'' are inwardly biased by the indwelling bead or ridge 1006 residing on the interior of the shell component proximate the lower margin 1004 thereof. As the lower margin 26'' of the liner component 10'' passes upwardly over the high point of the bead or ridge 1006, the forces of restitution within the cellular material of the liner component 10'' force the depending portions 14'', 16'' and 18'' thereof outwardly, thereby seating said liner component within the shell component with the lower margin 26'' resting above the bead or ridge 1006 and the depending portions 14'', 16'' and 18'' being resiliently constricted to a greater or lesser degree against the interior of the shell component 1000. Further, by this construction the opportunity is afforded by which to utilize liner components 10'' of a single size in combination with a number of shell components 1000 of different fixed head sizes, thereby significantly reducing the overall number of components which need to be manufactured and stocked to fit the headgear to persons of differing head sizes.

While the invention has been disclosed herein in connection with certain embodiments and certain structural and procedural details, it is clear that many changes, modifications and equivalents of the invention as illustratively described hereinabove can be employed by those skilled in the art without departing from the essential scope and spirit of the invention. Accordingly, it should be noted and understood that such changes within the principles of the invention are intended to be included within the scope of the claims below.

What is claimed is:

1. Impact protective headgear comprising:

(A) a molded skull encasing component composed of an impact energy absorptive cellular polymer material, said skull encasing component having a crown portion to overlie the top of the skull and, integral with and depending therefrom, front, side and back portions, the bottom edges of said depending portions defining a lower margin of said skull encasing component and at least two spaced apart slots extending downwardly from the periphery of said crown portion and coursing through said lower margin; and (B) an exterior shell composed of a tough, resilient, abrasion resistant non-cellular polymer material to receive and retain said skull encasing component therein, said exterior shell comprising an upper crown element having a crown portion and, depending from said crown portion, a front portion, side portions and a back portion, the lower ends of said depending portions being secured to a lower head encircling element comprising a frontal headband section, depending side sections and, extending rearwardly from said side sections, back tab sections, said back tab sections having opposed spaced apart free ends, the free end edge of each said tab section having an array of lacing holes therethrough and a lace reeved through said arrays of lacing holes, thereby defining adjustable constricting means whereby tightening of said lace acts to urge the spaced apart free ends of said tab sections together and to adjustably reduce the head size of said shell and said skull encasing component retained therein.

2. The headgear of claim 1 wherein said slots oppose one another.

3. The headgear of claim 1 comprising at least four of said slots.

4. The headgear of claim 1 wherein said slots are located only on said depending side portions of said skull encasing component.

5. The headgear of claim 1 including a plurality of ventilation apertures located at the periphery of said crown portion.

6. The headgear of claim 5 wherein said ventilation apertures are of elongate shape and are oriented generally radially with respect to said crown portion.

7. The headgear of claim 5 wherein each said slot extends from a separate one of said ventilation apertures.

8. The headgear of claim 1 wherein said molded skull encasing component is produced by expandable bead molding.

9. The headgear of claim 1 wherein said cellular polymer material of construction of said skull encasing component is a crystalline alpha-olefinic polymer selected from the group consisting of homopolymers and copolymers of ethylene and propylene.

10. The headgear of claim 1 additionally comprising a soft and resilient sheet foam padding element disposed over and secured to at least a portion of the inner surface of said skull encasing component.

11. The headgear of claim 10 wherein said padding element is composed of a polymeric foam.

12. The headgear of claim 11 wherein said polymeric foam is a crosslinked polyolefin.

13. The headgear of claim 10 wherein said padding element is releasably secured to the inner surface of said skull encasing component.

14. The headgear of claim 13 wherein the means by which said padding element is releasably secured to the inner surface of said skull encasing component comprises a hook and loop fastener system.

15. The headgear of claim 1 wherein said depending portions of said crown element are defined by a plurality of spaced apart leaves integral with said crown portion.

16. The headgear of claim 1 comprising, in addition, a soft compressible and resilient polymeric foam padding element secured to the interior of said lower head encircling element of said exterior shell so as to overlie portions of the skull of the wearer lying below the brain case, said foam padding element having a narrow front headband section, side sections sufficiently wider than said front headband section as to overlie the ears of the wearer and back sections narrower than said side sections and extending rearwardly of said side sections, said back sections being spaced apart from one another and said padding element substantially encircling the interior surface of said shell and having an upper margin which corresponds to and abuts the lower margin of said skull encasing component, thereby to support and secure said skull encasing component thereabove within said shell.

17. The headgear of claim 16 wherein said foam padding element is riveted to the interior of said lower head encircling element by means of a plurality of broad-headed polymeric rivets, each said rivet comprising interlocking female and male shaft elements.

18. The headgear of claim 16 wherein said foam padding element is composed of crosslinked polyethylene.

19. Impact protective headgear comprising:

(A) a molded skull encasing component composed of an impact energy absorptive cellular polymer material, said skull encasing component having a crown portion to overlie the top of the skull and, integral with and depending therefrom, front, side and back portions, the bottom edges of said depending portions defining a lower margin of said skull encasing component and at least two spaced apart slots extending from said crown portion and coursing downwardly through said lower margin; and (B) at least one exterior shell composed of a tough, resilient, abrasion resistant non-cellular polymer material to receive and retain said skull encasing component therein, each said shell defining a constricting means of fixed smaller size than said skull encasing component whereby said shell constricts said skull encasing component to a smaller head size upon receipt of said skull encasing component thereinto.

20. The headgear of claim 19 wherein said exterior shell is provided as a plurality thereof in a number of differing sizes of smaller size than said skull encasing component and wherein said skull encasing component is provided in a single size to be received and constricted to a smaller head size in any of said shells.

21. The headgear of claim 19 wherein said shell comprises a lower margin and an indwelling ridge running circumferentially about the interior thereof, proximate said lower margin, and said skull encasing component is sized such that upon insertion of said skull encasing component into said shell, the depending portions of said skull encasing component are inwardly biased by said indwelling ridge and the lower margin of said skull encasing component passes upwardly of said ridge, whereupon said biased depending portions snap sufficiently outwardly as to secure said skull encasing component within said shell component.

* * * * *